US005782939A

United States Patent [19]

Farbstein et al.

[11] Patent Number: 5,782,939

[45] Date of Patent: Jul. 21, 1998

[54] LOW COST COATED ABRASIVES

[75] Inventors: Burton Farbstein, Mechanicville; Bernard Loughlin, Averill Park, both of N.Y.; Christopher Gruel, Peoria, Ill.

[73] Assignee: Norton Company, Worcester, Mass.

[21] Appl. No.: 908,567

[22] Filed: Aug. 8, 1997

[51] Int. Cl.[6] ..... B24D 11/00

[52] U.S. Cl. ..... 51/295; 51/307; 51/308

[58] Field of Search ..... 51/295, 307, 308; 501/32

[56] References Cited

U.S. PATENT DOCUMENTS

| | | | |
|---|---|---|---|
| 1,830,757 | 11/1931 | Hartman | 51/308 |
| 4,799,939 | 1/1989 | Bloecher et al. | 51/295 |
| 4,919,991 | 4/1990 | Gadkaree | 501/32 |
| 5,110,322 | 5/1992 | Narayanan et al. | 51/295 |
| 5,496,386 | 3/1996 | Broberg et al. | 51/295 |
| 5,496,387 | 3/1996 | Culler | 51/295 |
| 5,584,896 | 12/1996 | Broberg et al. | 51/295 |

*Primary Examiner*—Deborah Jones

*Attorney, Agent, or Firm*—David Bennett

[57] ABSTRACT

Substantial cost saving can be realized in a coated abrasive structure employing a plurality of layers of particulate material, if at least one of the under-layers of particles is provided by a layer of ground glass.

8 Claims, No Drawings

LOW COST COATED ABRASIVES

BACKGROUND OF THE INVENTION

The present invention provides a low cost route to the manufacture of coated abrasives which allows the substitution of low cost materials for a portion of the structure without significant sacrifice in performance.

In the production of conventional coated abrasives, a backing material is coated with a maker coat and abrasive grain is adhered to the maker coat before the coat has solidified. A size coat may be applied over the abrasive grains to help with retention of the grain on the backing material. The backing material can optionally be treated with front and/or back size treatment to ready it to receive a maker coat and to enhance adhesion between the backing material and the maker coat.

The grain that gives the bulk of the performance characteristics of the coated abrasive is the top layer of grain. This is because the grain is applied in more than a single layer to ensure a uniform overall thickness to the coated abrasive product such that the maximum number of abrasive grains are active at any one moment of the grinding operation. This also tends to give a more secure support for the abrasive grains during the grinding operation.

For this reason grain is often applied in two or more operations with a first application by gravity feed and a second by an electrostatic (UP) deposition technique. The first (usually gravity-fed) layer, (the "under-layer"), is often a lower cost grain and a more expensive grain giving the advertised performance for the coated abrasive product is the UP-applied grain applied over the under-layer.

To ensure that the premium grain performs at the optimum level, it is common to add with the premium grain a filler of a less hard material that acts to space the abrasive grains apart and allow them to cut with maximum efficiency. Any suitably friable filler can be used and minerals such as limestone, chalk and talc have been proposed as well as hollow mineral particles, glass powders and beads. The use of such fillers reduces costs and increases efficiency.

The present invention provides another way to save costs without significantly reducing the performance of a coated abrasive.

DESCRIPTION OF THE INVENTION

The present invention provides a coated abrasive comprising a backing material and abrasive grains adhered to the backing material by means of a maker coat which further comprises an under-layer of ground glass between the abrasive grain and the backing material.

The invention also comprises a process for the production of a coated abrasive in which a maker coat is applied to a backing material and ground glass is applied to the maker coat before a second maker coat layer is applied over the ground glass and abrasive grains are applied to the second maker coat layer.

The present invention is to be distinguished from those teachings of the use of fillers in maker coats or the use of abrasive grains applied in admixture with friable filler or spacer materials as discussed above. In the present invention the ground glass is applied in a separate operation distinct from the operations in which an abrasive grain or maker coat is applied and indeed is intended to provide an under-layer upon which the abrading layer of abrasive grits is deposited.

While the main advantage of the use of ground glass to provide the under-layer is economic, it is also found that, with coated abrasives made using coarser grit sizes, say for example about 50 grit and coarser, there is actually an improvement in abrasive performance arising from the use of the ground glass under-layer of the invention. While the reason for this is not yet clear, it may be that the wear characteristics of the glass increase the pressure on the abrasive grits in the abrading layer making them fracture more easily and avoid glazing. In this way the cut rate can be maintained longer.

The particles of ground glass can have any convenient particle sizes but it is general preferred that the particles sizes are within the size range corresponding to nominal FEPA grit sizes 30 grit to about 400 grit, and preferably from about 40 to about 240 grit. The ground glass is preferably graded for particle size to avoid the presence of grossly oversized particles which might interfere with the production of a suitable substrate on which to apply the abrasive grains. It is found however that ground glass within a nominal FEPA grade does not have the same particle size distribution as an abrasive grain with the same nominal grit size would have. In fact it is heavily weighted towards the finer particle sizes. It appears however that this does not raise a problem and, whereas it is conventional to provide that the under-layer of abrasive in a multilayered structure is of the same grit size as the top abrasive layer, with a ground glass under-layer, the grit size of the ground glass is relatively neutral as regards the performance of the coated abrasive product in which it is incorporated. This gives rise to a further advantage of the use of ground glass in that the same ground glass stock can be used to provide an under-coat layer for coated abrasives made using abrasive grits with a range of up to about four or more consecutive abrasive grit sizes. A reduction of the stock items that must be maintained to provide the full spectrum of abrasive products with varying grit sizes leads to significant reductions in cost and space. Preferably however the volume average particle size of the ground glass is within about 25% of the nominal particle size ofthe abrasive layer as determined by the FEPA grit size.

The nature of the glass is relatively unimportant from the point of view of the coated abrasive performance. It is therefore advantageous to use the cheapest material available and this is usually recycled ground glass. This substitution raises the most significant advantage arising from the use of the present invention and that is the reduced cost. Fused alumina abrasive grits, which are the grits that usually provide the under-layer materials, are made by a process that involves raising the raw materials to temperatures at which they are molten. This molten material is then usually cooled and physically crushed and graded to the desired particle size distribution. As will be appreciated, the cost of materials processed in such a fashion is much higher than that of ground up recycled glass.

The term "ground glass" is herein used to describe glass that has been comminuted by any convenient form such as for example by crushing and sizing or by pouring a stream of molten glass into water.

The ground glass layer can have any convenient thickness but in practice the most useful thickness ranges from about 0.5 to about 1.5 times the thickness of the abrasive layer and preferably from about 0.65 times, to about equal to the thickness of the abrasive layer that is laid over the under-layer. Normally an under-layer is applied on a weight basis but since the ground glass is significantly less dense than most abrasive grits for which it might be substituted, a proportionately lower coating weight is typically used.

In the preferred processes of the invention the ground glass is applied by a gravity coating operation since untreated glass powder will not readily coat by a UP process.

The abrasive grits can be any of those employed in coated abrasives including alumina, (both fused and sintered), fused alumina/zirconia, silicon carbide, cubic boron nitride and the like. Most frequently the abrasive layer comprises alumina abrasive grits.

DESCRIPTION OF THE PREFERRED EMBODIMENTS

The invention is now described with specific reference to the following Examples which are presented solely for the purpose of illustrating the invention and are intended to imply no essential limitation on the scope of the invention.

EVALUATION PROCEDURES

In evaluating the abrasive discs produced with a powder glass under-layer, several different grinding procedures were used. In each case a first disc or belt (C-1) was made on a pilot plant line according to a procedure and using materials that were exactly the same as are used for a commercial product. This formed the basis for comparison. A second comparison sample (C-2) was taken from the commercial production of the discs or belts whose manufacturing procedure was replicated on the pilot line. This served as an indication of any performance variation between the pilot line and the regular commercial production line. Finally a product made according to the procedures of the invention (I-1), with a powder glass under-layer in place of the conventional alumina layer, was evaluated. These three samples were tested for each grit size evaluated.

Three different evaluation procedures were used and the details of each are as follows:

122Ds

In this test the applied force is 40–80 lbf, (276–552 Knewtons/$^2$) depending on the grit size evaluated and the test material is a 1"×1"×36" (2.54×2.54×91.4 cm), 4140 cold drawn steel bar.

The abrasive sample belt is mounted on a 90 Durometer plain faced rubber contact wheel and is run at a rate of 5000 surface feet/minute (1524 surface meters/minute) The test piece holder is adapted to force the 1" square (2.54 cm square) end into contact with the moving abrasive surface with a force of 40 to 80 psi, (276–552 Knewtons/m$^2$), depending on the grit size. The force is applied and removed to allow a 3 second grinding interval followed by a thirty second cooling period. The test is ended when the cut per cycle falls below 0.030 inch, (o.o76cm.), per minute or the completion of 90 cycles, whichever comes first. The amount of metal removed per cycle, the number of cycles and the total amount of metal are recorded. The applied weight could be varied with the grit size as desired.

102Ds

This test is performed on 4140 steel. The equipment used comprises motor driven apparatus upon which an abrasive belt to be tested is mounted. In this test the belt is brought into contact with the workpiece. Belt speed is 5000 surface feet per minute, (1525 surface meters/minute).

In this configuration, the belt is brought into contact with a 0.5"×3"×9.75", (1.27×7.62×24.80 cm), metal bar is forced into contact with the disc. The force applied was 8 lbf. (35.6 newtons). The bar is abraded on its 0.5×3" (1.27×7.62 cm) face in a conventional back and forth grinding motion for a two minute period after which the bar is allowed to cool. In the grinding cycle the bar is oscillated at a rate of 7 feet per minute, (2.13 meters/minute). The amount of metal removed during the grinding cycle is measured and the cycle is then repeated until the cut per cycle falls below 3 gm/minute for 4140 steel.

112DsH

The fiber disc is applied to grind the 0.125 inch, (0.32 cm), edge of a 1"×1"×9.75", (2.54×2.54×24.8 cm), angle iron made from A-36 H.R. steel. The angle iron is first weighed and is then mounted on the specimen holder which reciprocated back and forth over a distance of 9.75 inches, (24.8 cm), at a rate of 8.5 strokes per minute and a linear speed of 7 feet/minute, (2.14 meters/minute) while being contacted with the abrasive disc at a pressure of 10 to 12 lbf, (44.5 to 53.4 newtons), depending on the abrasive grit size. The abrasive disc is driven at 3,450 rpm. The grinding cycle is two minutes after which the angle iron specimen is removed and the loss of weight recorded. This cycle is then repeated with new angle iron specimens inserted as required until a minimum grinding rate of 10 grams/minute is reached.

This ends the test. The data is recorded in terms of grams removed per 2 minute interval, number of intervals to the end of the test and the total cut, (grams removed) by the disc under evaluation.

EXAMPLE 1

Abrasive belts were made using a conventional cotton backing, phenolic maker and size coats and an alumina abrasive layer of BEPLCC alumina available from Treibacher AG. The C-1 and C-2 comparative samples had under-layers of OPL alumina from Treibacher AG. In each case the grit size of the under-layer was matched with that of the abrasive layer.

The abrasive discs of the invention differed only in that the under-layer was made from ground glass. The applied weight of the glass was lower than that of the OPL alumina in the comparative samples because of the difference in densities, (glass has a density about 0.62 that of alumina). The intention was to apply essentially equal volumes of under-layer but, because the spread of particles sizes in the ground glass used tended to be skewed towards a larger small particle fraction than would be permitted in strict FEPA grading, the amount of ground glass actually used tended to be even lower than the proportionately equivalent amount of alumina. The under-layer in each case was gravity coated and the abrasive layer in each case was UP-coated. Two sets of tests were conducted using the 102Ds test technique described above. The results are shown on Table 1 below.

TABLE 1

| SAMPLE | GRIT SIZE | CUMULATIVE CUT (% CONTROL) |
|---|---|---|
| C-1 | 36 | 100% |
| I-1 | 36 | 109% |
| C-2 | 36 | 108% |
| C-1 | 50 | 100% |
| I-1 | 50 | 96% |
| C-2 | 50 | 79% |
| C-1 | 100 | 100% |
| I-1 | 100 | 93% |
| C-2 | 100 | 91% |
| C-1 | 36 | 100% |
| I-1 | 36 | 135% |
| C-2* | 36 | 151% |

TABLE 1-continued

| SAMPLE | GRIT SIZE | CUMULATIVE CUT (% CONTROL) |
|---|---|---|
| C-1 | 50 | 100% |
| I-1 | 50 | 115% |
| C-2 | 50 | 105% |
| C-1 | 80 | 100% |
| I-1 | 80 | 95% |
| C-2 | 80 | 92% |

* This product showed much better grain orientation in the abrasive layer than the products with which it was compared. This explains the excellent performance that was not duplicated in the parallel series of evaluations shown in the upper part of the Table.

Overall it appears that the substitution of the ground glass for the alumina has no significant effect on the abrading performance, the differences indicated being relatively insignificant. It was noted in all groups of tests that the products cut at about the same level of aggressiveness, for about the same length of time and lost about the same amount of weight during the tests.

EXAMPLE 2

In this Example the 122 Ds test procedure was used with minor modifications in that the applied pressure was varied with the grit size as follows: 36 grit—80 psi; (552 Knewtons/$m^2$); 50 grit—60 psi, (414 Knewtons/$m^2$); and 100 grit —30 psi., (207 Knewtons/$m^2$). The same pattern of tests was carried out are described in Example 1 and the results are shown in Table 2 below.

TABLE 2

| SAMPLE | GRIT SIZE | CUMULATIVE CUT (% CONTROL) |
|---|---|---|
| C-1 | 36 | 100% |
| I-1 | 36 | 123% |
| C-2 | 36 | 104% |
| C-1 | 50 | 100% |
| I-1 | 50 | 103% |
| C-2 | 50 | 88% |
| C-1 | 100 | 100% |
| I-1 | 100 | 96% |
| C-2 | 100 | 107% |

In this series of tests a pattern of superiority at the coarser grit levels seems to emerge with little to choose between the performances at the finer grit sizes.

EXAMPLE 3

In this Example the evaluation test was 112 DsH as described above. The test materials were again chosen in the same way except that two different commercial target formulations were selected. The same under-layers were used in the standards as were used in the previous examples. Also the binders and abrasive layers were all the same. The results are shown in Table 3 below.

TABLE 3

| SAMPLE | GRIT SIZE | CUMULATIVE CUT (% CONTROL) |
|---|---|---|
| C-1 | 36 | 100% |
| I-1 | 36 | 96% |
| C-2 | 36 | 105% |
| C-1 | 36 | 100% |

TABLE 3-continued

| SAMPLE | GRIT SIZE | CUMULATIVE CUT (% CONTROL) |
|---|---|---|
| I-1 | 36 | 113% |
| C-2 | 36 | 90% |

Once again the product according to the invention is about as good as the commercial products. And this is achieved with a very significant cost saving.

EXAMPLE 4

In this Example the peel adhesion of glass as opposed to an OPL alumina was assessed. Two test samples were prepared in which a standard commercial cotton belt backing material was given a standard maker coat application before OPL alumina (or ground glass as the case may be), was applied, using a gravity coating technique, to the maker coat which was then cured. The difference in weight applied, (55.3 gm of OPL alumina as opposed to 36.9 gm of ground glass), is a reflection only of the different densities of the materials. The particle sizes of both were nominally 50 grit.

The materials were subjected to a standard Schieffer test to assess the weight loss when abraded using an aluminum workpiece under a 10 lb. (0.45 kg), weight. The alumina disc loss was 0.299 gm from an initial disc weight of 8.053 gm. The ground glass disc weight loss was 0.225 gm from an initial disc weight of 7.026 gm. Thus there is little to choose between the two under this test.

The peel adhesion of the alumina sample was 13.92 lb. whereas that of the ground glass sample was 14.3 lb. (6.44 kg). Thus it seems clear that the ground glass is at least as good as the alumina in resisting weight loss or delamination.

What is claimed is:

1. A coated abrasive comprising a backing material and an abrasive layer comprising abrasive grits and a maker coat, in which a under-layer of ground glass is interposed between the abrasive layer and the backing.

2. A coated abrasive according to claim 1 wherein the ground glass under-layer is adhered to the backing by a maker coat and the abrasive layer is applied over the ground glass under-layer.

3. A coated abrasive according to claim 1 wherein the ground glass under-layer has a volume average particle size that is within 25% of the grit size of the abrasive grits.

4. An abrasive disc consisting of a coated abrasive according to claim 1.

5. An abrasive belt consisting of a coated abrasive according to claim 1.

6. A process for the production of a coated abrasive which comprises:

a) providing a backing material;

b) applying a first maker resin coat to the backing material;

c) applying a substantially uniform coating of ground glass to the first maker coat to form an under-layer;

d) applying a second maker coat over the glass under-layer;

e) applying a substantially uniform layer of abrasive grits over the second maker layer; and f) completing the cure of the first and second maker layers.

7. A process according to claim 6 in which the ground glass under-layer is applied by a gravity fed process.

8. A process according to claim 6 in which a size coat is applied over the abrasive grits.

* * * * *